US005357890A

United States Patent [19]

Mason, Jr. et al.

[11] Patent Number: 5,357,890

[45] Date of Patent: Oct. 25, 1994

[54] BOAT KEEL/HULL PROTECTOR

[76] Inventors: John E. Mason, Jr.; Kenneth J. Mason, both of 123 Circle Dr., East, Montgomery, Ill. 60538

[21] Appl. No.: 143,077

[22] Filed: Oct. 25, 1993

[51] Int. Cl.[5] ..... B63B 59/02

[52] U.S. Cl. ..... 114/219; 114/343

[58] Field of Search ..... 114/219, 343, 361, 364, 114/221 R

[56] References Cited

U.S. PATENT DOCUMENTS

| | | | |
|---|---|---|---|
| D. 264,579 | 5/1982 | Dorsey et al. . | |
| D. 299,078 | 12/1988 | Jacobsen . | |
| 3,055,022 | 9/1962 | Vallquist | 114/219 |
| 3,220,026 | 11/1965 | Lichti . | |
| 3,693,574 | 9/1972 | Dickey . | |
| 3,820,495 | 6/1974 | Ueda | 114/219 |
| 3,950,953 | 4/1976 | Matthews | 114/219 |
| 4,260,282 | 4/1981 | Dorsey et al. . | |
| 4,751,891 | 6/1988 | Wilson | 114/219 |
| 4,803,942 | 2/1989 | Dren et al. . | |
| 4,815,412 | 3/1989 | Cassaro, Jr. . | |
| 4,909,172 | 3/1990 | Hamby | 114/219 |
| 4,962,719 | 10/1990 | Hughes et al. . | |
| 4,972,791 | 11/1990 | Williams . | |
| 5,076,195 | 12/1991 | Heyne . | |

*Primary Examiner*—Stephen P. Avila

*Attorney, Agent, or Firm*—Wood, Phillips, Van Santen, Hoffman & Ertel

[57] ABSTRACT

In order to prevent damage to the keel and/or hull of a boat during beached landings on gravel, sand, mud or rocky shorelines, a boat keel/hull protector is provided. It comprises a flexible, elongated body member having a central portion and a pair of opposed side portions wherein the elongated body member is formed to accommodate desired positioning thereof relative to the keel. With these features of construction, the boat keel/-hull protector also includes a tie-down cord for securing the body member after it has been positioned relative to the keel.

18 Claims, 2 Drawing Sheets

BOAT KEEL/HULL PROTECTOR

FIELD OF THE INVENTION

The present invention is generally related to boating accessories and, more particularly, a device for protecting the keel and/or hull of a boat.

BACKGROUND OF THE INVENTION

For many years, pleasure boating has been something that is enjoyed by a vast number of people from all walks of life. It is well known that the pleasure boating industry has evolved into a significant segment of the economy, and it is not at all uncommon for families to own boats of many different types. Depending upon the personal interests of a boat owner, it is possible to own any of a variety of different types of boats.

More specifically, it is commonly known that boating enthusiast run the gamut from fisherman to power boaters to sailors. It is typically the case, however, that regardless of the particular interest of a boat owner, the fact is that any pleasure boat represents a substantial investment which usually ranges into many thousands of dollars. As a result, most boat owners are motivated to protect their boats not only because of pride, but also from an investment viewpoint.

Despite these motivating factors, the boat owner will in many cases be in a situation where the boat must actually be beached on a gravel, sand, mud, or rocky shoreline. This is particularly common, for instance, where docks are not readily available for use such as where the boat is beached in an uninhabited area of a river or lake for picnicking, camping, and trailering, as well as in many fishing environments and the like. When this is encountered, the keel and/or hull of a boat; particularly in the commonly V-shaped bow area, can easily be damaged from abrasion and/or impact with the shoreline surface.

Still additionally, these areas of a boat, i.e., the keel and/or hull, can be damaged after beaching while the boat is parked. It is typical in this connection to moor a boat on a beach by tying off the bow of the boat by using an eyebolt and rope to secure the bow of the boat to a permanent object such as a tree or the like, and the stem of a boat may be held against swinging around onto the shoreline by means of anchors. While this may acceptably secure the boat, a current and/or waves may cause rocking and/or movement relative to the shoreline.

Without protection, this movement of the bow of a boat is known to cause damage thereto. The back-and-forth or rocking movement of the bow relative to a sand, gravel, mud, or rocky shore, regardless of whether the hull is formed of fiberglass, metal, or wood, causes scratching of the surface at best which depreciates the value of the boat. At worst, the relative movement of the bow on the shoreline can be a source of structural damage.

As will be appreciated, this can occur where the boat is beached on the shoreline in a storm or other adverse conditions. The wave action and/or wind force can cause such violent rocking motion, particularly on a gravel or rocky shoreline, that it is actually capable of wearing a hole through the hull in extreme cases. Clearly, this type of damage is costly and greatly diminishes the value of the boat thereby eroding the owner's investment.

In view of the foregoing, there is a significant need to be able to protect the keel and/or hull of a boat in a beaching circumstance.

The present invention is directed to overcoming one or more of the foregoing problems and achieving one or more of the resulting objects.

SUMMARY OF THE INVENTION

It is a principal object of the present invention to provide a device for protecting the bottom of boats to preserve their value. It is a further object of the present invention to provide a boat keel/hull protector that is particularly suited for protecting a boat in a beaching situation. It is an additional object of the present invention to provide such a protective device which is capable of easy installation and removal from a boat.

Accordingly, the present invention is directed to a boat keel/hull protector comprising a flexible, elongated body member. The body member has a central portion and a pair of opposed side portions, and the protector further includes means associated with the body member for positioning it relative to the keel as well as means for securing the body member after it has been suitably positioned relative to the keel. Advantageously, the positioning means includes a generally V-shaped groove and the securing means includes a plurality of tie-down cords.

In the exemplary embodiment, the central portion of the body member has a thickness dimension greater than the thickness dimension of the side portions of the body member. It will be appreciated in this connection that the central portion of the body member has oppositely facing surfaces, one of which is the surface in which the generally V-shaped groove is formed. Further, the boat keel/hull protector is formed such that the side portions of the body member preferably have outermost edges such that tie-down cords are integral with each of them.

In a highly preferred embodiment, the body member is formed of a solid rubber-like material, and the central portion is outwardly tapered from one width at one end to another, greater width at the other end thereof. Likewise, the side portions are preferably outwardly tapered from one width at one end to another, greater width at the other end thereof. Still additionally, the side portions of the body member advantageously taper from in thickness from one thickness adjacent the central portion of the body member to a narrower thickness near an outermost edge thereof.

Still additional details of the present invention include the central portion of the body member having a greater thickness dimension than the maximum thickness dimension of the side portions of the body member. It is also advantageous for there to be a tie-down integrally associated with at least the opposite ends of the outermost edges of the side portions of the elongated body member. Most advantageously, the boat keel/hull protector is formed such that a tie-down cord is integrally associated with a forward end, a rearward end, and an intermediate point along each of the outermost edges of the side portions.

With this arrangement, a still further advantageous feature of the invention is for the tie-down cords integrally associated with the rearward end of each of the outermost edges to extend upwardly and rearwardly at an angle of between 20° and 45°.

As for other features of the invention, the central portion of the elongated body member preferably has a substantially uniform thickness dimension in contrast to the side portions of the elongated body member which have a tapered thickness dimension. It is also advantageous for the central and side portions of the elongated body member to define a continuous top surface in which the generally V-shaped groove is formed. On the other hand, the central and side portions of the elongated body member preferably define a stepped bottom surface which includes a radius comer where each of the side portions is integrally joined to the central portion.

As for other features of the present invention, the boat keel/hull protector advantageously includes an eyebolt-receiving slot through the central portion of the elongated body member at a forward end extending through the generally V-shaped groove to permit use of a bow tie-up rope with the usual bow eyebolt.

Other objects, advantages and features of the present invention will become apparent from a consideration of the following specification taken in conjunction with the accompanying drawings.

DETAILED DESCRIPTION OF THE PREFERRED EMBODIMENT

Figure 1:
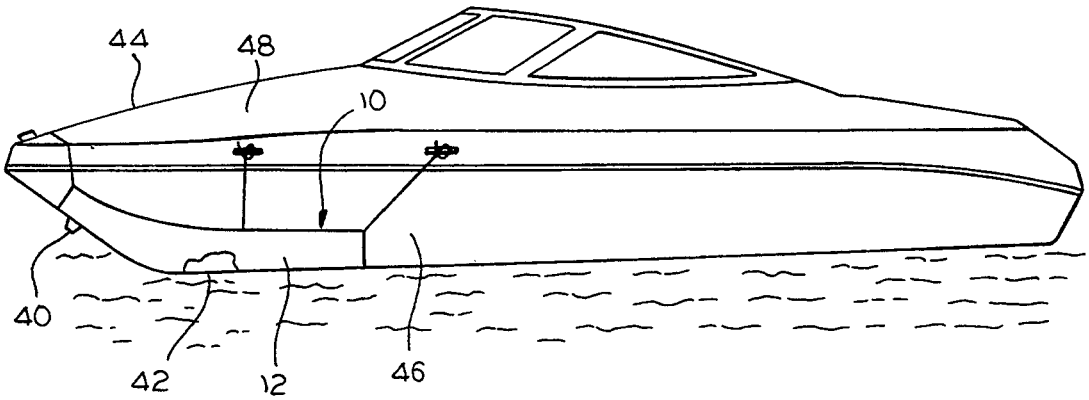
FIG. 1 is a perspective view of a boat keel/hull protector on a boat according to the present invention.

In the illustrations given, and with reference first to FIG. 1, the reference numeral 10 designates generally a boat keel/hull protector in accordance with the present invention. It will be seen to include a flexible, elongated body member 12 having a central portion 14 and a pair of opposed side portions 16*a* and 16*b* (see, also, FIG. 2). Additionally, the boat keel/hull protector 10 includes means associated with the body member 12 for positioning it relative to a keel and means for securing the body member 12 after it has been positioned relative to the keel.

Figure 3:
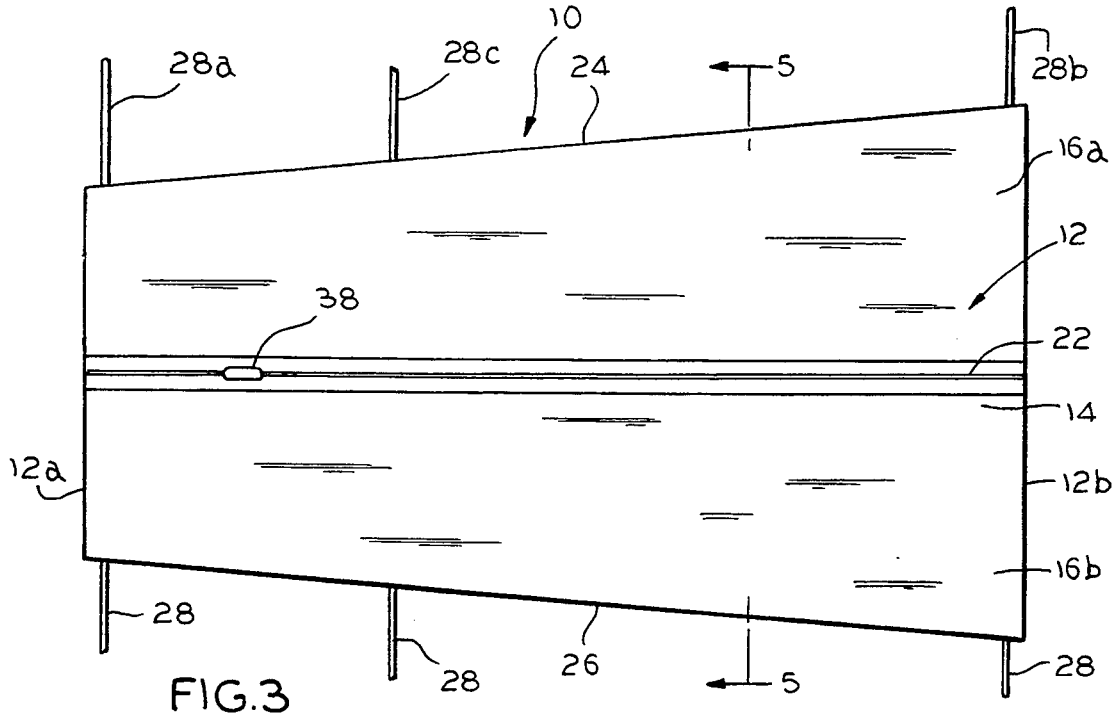
FIG. 3 is a top plan view of the boat keel/hull protector as illustrated in FIG. 1.
Figure 4:
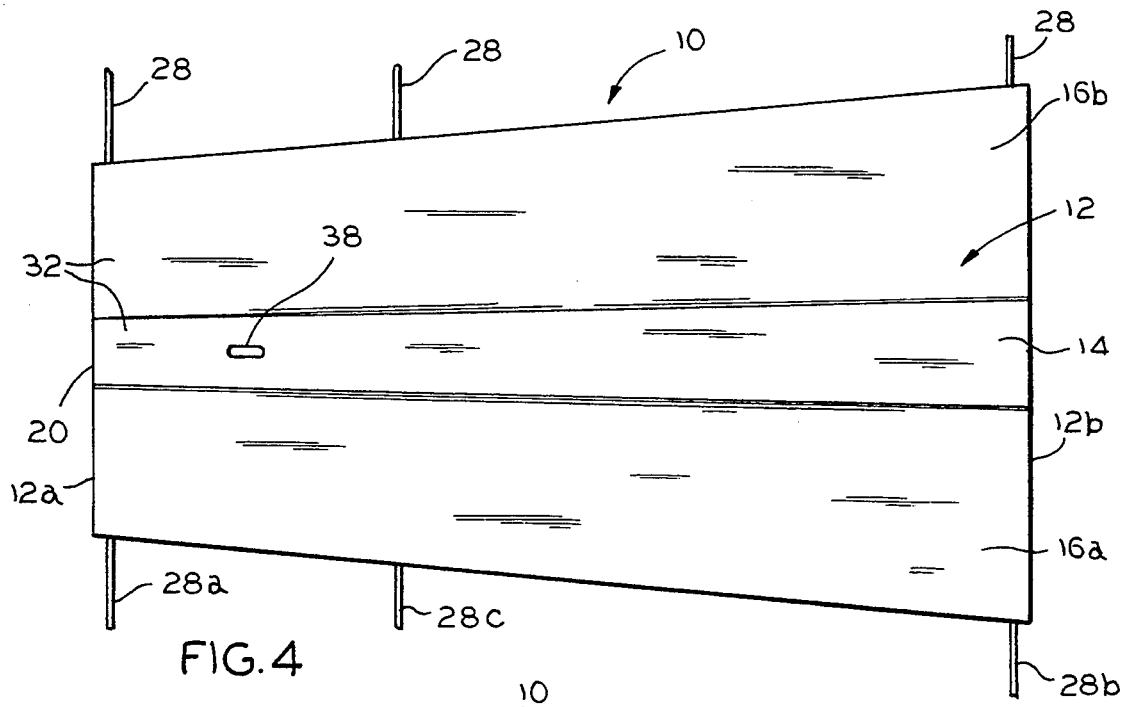
FIG. 4 is a bottom plan view of the boat keel/hull protector as illustrated in FIG. 1.

More specifically, the central portion 14 of the body member 12 has oppositely facing surfaces 18 and 20 (see FIGS. 3 and 4) and the positioning means includes a generally V-shaped groove 22 formed in one of the surfaces 18. As also shown, the side portions 16*a* and 16*b* of the body member 12 have outermost edges 24 and 26 (see, also, FIG. 5) and the securing means includes a plurality of tie-down cords 28 integral with each of the outermost edges 24 and 26.

Figure 5:
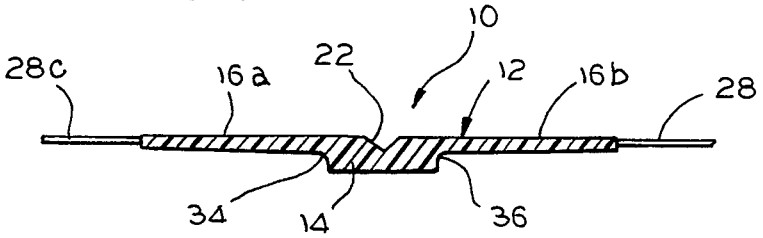
FIG. 5 is a cross-sectional view of the boat keel/hull protector taken on the line 5—5 of FIG. 2.

As best shown in FIG. 5, the central portion 14 of the body member 12 has a thickness dimension greater than the thickness dimension of the side portions 16*a* and 16*b* of the body member 12. It is advantageous for the body member 12 to be formed of a solid rubber-like material such that the central portion 14 is outwardly tapered from one width at one end 12*a* to another, greater width at the other end 12*b* thereof (see FIGS. 3 and 4) and, similarly, the side portions 16*a* and 16*b* are outwardly tapered from one width at the one end 12*a* to another, greater width at the other end 12*b* thereof. Additionally, the side portions 16*a* and 16*b* of the body member 12 preferably taper from one thickness adjacent the central portion 14 to a narrower thickness near the outermost edges 24 and 26 thereof.

Still referring to FIG. 5, the central portion 14 of the elongated body member 12 has a minimum thickness dimension substantially greater than the maximum thickness dimension of the side portions 16*a* and 16*b* of the elongated body member 12. It will also be appreciated from the foregoing that the central portion 14 of the elongated body member 12 has a substantially uniform thickness dimension and, further, that the side portions 16*a* and 16*b* of the elongated body member 12 each have a tapered thickness dimension. As previously suggested, the side portions 16*a* and 16*b* of the elongated body member 12 taper from a maximum thickness dimension adjacent the central portion 14 to a minimum thickness dimension at the outermost edges 24 and 26 thereof.

Figure 2:
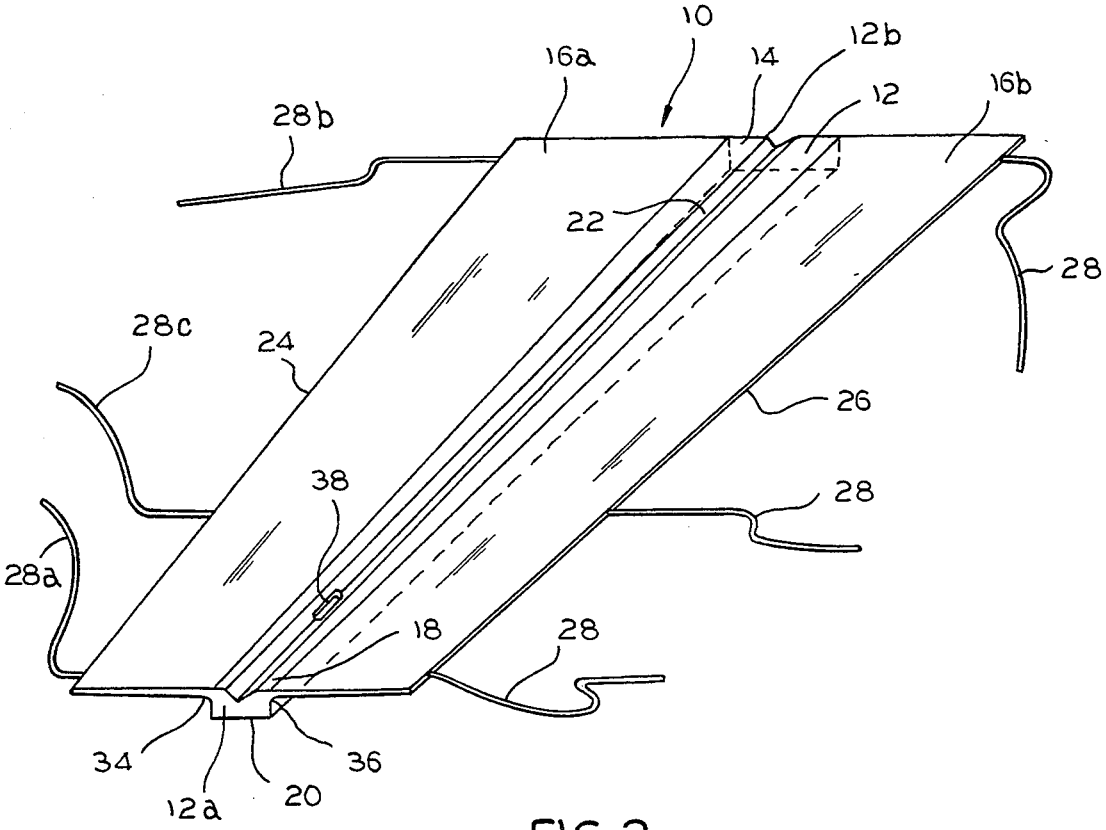
FIG. 2 is a perspective view of the boat keel/hull protector as illustrated in FIG. 1.

Referring to FIGS. 2 and 5, it will be seen and appreciated that the central portion 14 and side portions 16*a* and 16*b* of the elongated body member 12 define a continuous top surface 30 in which the generally V-shaped groove 22 is formed. As also shown, the central portion 14 and side portions 16*a* and 16*b* of the elongated body member 12 define a stepped bottom surface 32 including a radius corner 34 and 36 where each of the side portions 16*a* and 16*b* is integrally joined to the central portion 14.

As for other details of the invention, the boat keel/hull protector 10 preferably includes an eyebolt-receiving slot 38 through the central portion 14 of the elongated body member 12 at a forward end 12*a* extending through the generally V-shaped groove 22. This permits use of the boat keel/hull allowing a fie-up rope on the conventional bow eyebolt 40 to be utilized in the typical fashion by feeding the rope through the slot 38 and positioning the eyebolt 40 in or projecting it through the slot 38 (see FIG. 1). Furthermore, the outward taper in width of both the central portion 14 and the side portions 16*a* and 16*b* of the elongated body member 12 is a taper from one width at the forward end 12*a* to another, greater width at the rearward end 12*b* thereof.

With this taper, the body member 12 is able to not only cover the keel 42 of a boat 44 but also to conform to and wrap around a portion of the hull 46 at least in the region of the bow 48 of the boat 44 (see FIGS. 1 and 5). In other words, the outward taper of the central portion 14 and the side portions 16*a* and 16*b* of the elongated body member 12 allows conformity to and protection for the keel 42 and most of the hull 46 in the region of the bow 48.

In this connection, the configuration of the elongated body member 12 is advantageous for use with nearly any boat having a generally V-shaped bow cross-section.

Referring to FIGS. 1 and 2, the boat keel/hull protector 10 preferably includes a tie-down cord 28*a* and 28*b* integrally associated with at least the opposite ends of the outermost edges 24 and 26 of the side portions 16*a* and 16*b*. It has been found advantageous, however, for there to be a tie-down cord 28a integrally associated with a forward end, a tie-down cord 28*b* integrally associated with the rearward end, and a tie-down cord 28*c* integrally associated with an intermediate point along each of the outermost edges 24 and 26 of the side portions 16*a* and 16*b*. Still additionally, and as clearly shown in FIG. 1, the tie-down cords 28*b* integrally associated with the rearward end extend upwardly and rearwardly from the outermost edges 24 and 26 at an angle of between 20° and 45°.

With regard to the tie-down cords, they may be stretchable or elastic bungie material or fixed-length rope material integrally bonded into the side portions of the elongated body member. Alternatively, the side portions could have eyelets through which tie-down cords may pass and be conventionally secured. If desired, the tie-down cords at the forward end along each of the outermost edges of the side portions may comprise a single cord formed of stretchable or elastic bungie material.

With this configuration, the single fie-down cord can be looped over the deck at the bow of the boat with the remaining tie-down cords **28*b* and 28*c*** tied off to cleats or the like on the deck at points rearward thereof.

With the boat keel/hull protector, it is easy to install and easy to remove since it slips on without requiting the user to enter the water. The generally V-shaped groove acts as a guide whereby the protector may be loosely secured by the tie-down cords at the forward end with the other tie-down cords at the intermediate point and rearward end being used to pull the protector rearwardly with the keel nested in the generally V-shaped groove until there is tension in the tie-down cord or cords at the forward end following which the tie-down cords at the intermediate point and rearward end may be tied off to cleats to firmly secure the protector in place with the side portions in engagement with the hull on opposite sides of the keel of the boat. With the keel nested in the generally V-shaped groove, the keel will not slip out of the central portion of the elongated body member.

In one practical embodiment, the central portion tapers from a width of 2 to 4 inches at the forward end to a width of 5 to 6 inches at the rearward end and the side portions taper from a width of on the order of 8 inches at the forward end to a width of on the order of 12 inches at the rearward end. It would also preferably be formed such that the central portion would be on the order of $1\frac{1}{4}$ inches thick having a generally V-shaped groove of $\frac{3}{4}$ inch in width and depth with the side portions tapering from approximately $\frac{3}{4}$ of an inch thickness adjacent the central portion to $\frac{3}{8}$ inch thick at the outermost edges thereof. For a typical application at least in pleasure boating, the elongated body member having the various taper and thickness magnitudes which have been described herein will be on the order of approximately 5 to 6 feet in length and will have tie-down cords also on the order of approximately 5 to 6 feet in length.

While in the foregoing there has been set forth a preferred embodiment of the invention, it will be appreciated that the details herein given may be varied by those skilled in the art without departing from the true spirit and scope of the appended claims.

We claim:

1. A boat keel/hull protector, comprising:

a flexible, elongated body member having a central portion with oppositely facing surfaces and a pair of opposed side portions with outermost edges remote from said central portion of said body member, said side portions of said body member each tapering from one thickness adjacent said central portion of said body member to a narrower thickness near the corresponding one of said outermost edges thereof;

means associated with said body member for slidably positioning said central portion of said body member onto said keel including a generally V-shaped keel-conforming groove in one of said oppositely facing surfaces of said central portion of said body member; and means for drawing said side portions of said body member into engagement with said hull and securing said body member against movement relative to said keel and hull after said central portion of said body member has been slidably positioned onto said keel.

2. The boat keel/hull protector of claim 1 wherein said central portion of said body member has a thickness dimension greater than the thickness dimension of said side portions of said body member.

3. The boat keel/hull protector of claim 1 wherein said side portions of said body member have outermost edges and said securing means includes a plurality of tie-down cords integral with each of said outermost edges.

4. The boat keel/hull protector of claim 1 wherein said body member is formed of a solid rubber-like material and said central portion is outwardly tapered from one width at one end to another, greater width at the other end thereof.

5. The boat keel/hull protector of claim 1 wherein said body member is formed of a solid rubber-like material and said side portions are outwardly tapered from one width at one end to another, greater width at the other end thereof.

6. The boat keel/hull protector of claim 1 wherein said central portion of said body member has a thickness dimension greater than the maximum thickness dimension of said side portions of said body member.

7. A boat keel/hull protector, comprising:

a flexible, elongated body member having a central portion with oppositely facing surfaces and a pair of opposed side portions with outermost edges remote from said central portion of said body member, said side portions of said body member each tapering from one thickness adjacent said central portion of said body member to a narrower thickness near the corresponding one of said outermost edges thereof;

said central portion of said body member having a minimum thickness dimension substantially greater than the maximum thickness dimension of said side portions of said body member;

means associated with said body member for slidably positioning said central portion of said body member onto said keel including a generally V-shaped keel-conforming groove in one of said oppositely facing surfaces of said central portion of said body member; and means for drawing said side portions of said body member into engagement with said hull and securing said body member against movement relative said keel and hull after said central portion of said body member has been slidably positioned onto said keel including a tie-down cord integrally associated with at least the opposite ends of said outermost edges of said side portions of said body member.

8. The boat keel/hull protector of claim 7 wherein said elongated body member is formed of a solid rubber-like material and said central portion is outwardly tapered from one width at one end to another, greater width at the other end thereof.

9. The boat keel/hull protector of claim 7 wherein said elongated body member is formed of a solid rubber-like material and said side portions are outwardly tapered from one width at one end to another, greater width at the other end thereof.

10. The boat keel/hull protector of claim 7 wherein said central portion of said elongated body member has substantially uniform thickness dimension.

11. The boat keel/hull protector of claim 10 wherein said side portions of said elongated body member taper from a maximum thickness dimension adjacent said central portion to a minimum thickness dimension at said outermost edges thereof.

12. The boat/keel hull protector of claim 10 wherein said central and side portions of said elongated body member define a continuous top surface and said generally V-shaped groove is in said continuous top surface.

13. The boat keel/hull protector of claim 10 wherein said central and side portions of said elongated body member define a stepped bottom surface including a radius corner where each of said side portions integrally joins said central portion.

14. The boat keel/hull protector of claim 7 including a eyebolt-receiving slot through said central portion of said elongated body member at a forward end extending through said generally V-shaped groove to permit use of a bow tie-up bolt.

15. A boat keel/hull protector, comprising:

a flexible, elongated body member having a central portion with oppositely facing surfaces and a pair of opposed side portions with outermost edges remote from said central portion of said body member, said side portions of said body member each tapering from one thickness adjacent said central portion of said body member to a narrower thickness near the corresponding one of said outermost edges thereof;

said central portion of said body member having a minimum thickness dimension substantially greater than the maximum thickness dimension of said side portion of said body member;

means associated with said body member for slidably positioning said central portion of said body member onto said keel including a generally V-shaped keel-conforming groove in one of said oppositely facing surfaces of said central portion of said body member;

means for drawing said side portions of said body member into engagement with said hull and securing said body member against movement relative to said keel and hull after said central portion of said body member has been slidably positioned onto said keel including a tie-down cord integrally associated with at least the opposite ends of said outermost edges of said side portions of said body member;

said central and side portions of said body member defining a continuous top surface and said positioning means including said generally V-shaped keel-conforming groove being in said continuous top surface, said central and side portions of said body member defining a stepped bottom surface including a radius corner where each of said side portions integrally joins said central portion, and including an eyebolt-receiving slot through said central portion of said body member at a forward end extending through said generally V-shaped keel-conforming groove to permit use of a bow tie-up bolt.

16. The boat keel/hull protector of claim 15 wherein said elongated body member is formed of a solid rubber-like material, said central portion being outwardly tapered from one width at a forward end to another, greater width at a rearward end of said elongated body member, said side portions also being outwardly tapered from one width at a forward end to another, greater width at a rearward end of said elongated body member.

17. The boat keel/hull protector of claim 15 wherein said central portion of said elongated body member has a substantially uniform thickness dimension, said side portions of said elongated body member tapering from a maximum thickness dimension adjacent said central portion to a minimum thickness dimension at said outermost edges thereof.

18. The boat keel/hull protector of claim 15 wherein said securing means includes a tie-down cord integrally associated with a forward end, a rearward end, and an intermediate point along each of said outermost edges of said side portions of said elongated body member such that said tie-down cords integrally associate with said rearward end extend upwardly and rearwardly at an angle of between 20 and 45 degrees.

* * * * *